US011591672B2

(12) United States Patent
Vincent et al.

(10) Patent No.: US 11,591,672 B2
(45) Date of Patent: Feb. 28, 2023

(54) GREY GOLD ALLOY

(71) Applicant: The Swatch Group Research and Development Ltd, Marin (CH)

(72) Inventors: Denis Vincent, Neuchatel (CH); Polychronis Nakis Karapatis, Premier (CH); Gregory Kissling, Macolin (CH); Stephane Lauper, Cortaillod (CH); Gaetan Villard, L'Abbaye (CH); Alban Dubach, Bienne (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/052,011

(22) Filed: Feb. 24, 2016

(65) Prior Publication Data

US 2016/0273077 A1 Sep. 22, 2016

(30) Foreign Application Priority Data

Mar. 17, 2015 (EP) ..... 15159421

(51) Int. Cl.

| | |
|---|---|
| ***C22C 5/02*** | (2006.01) |
| ***C22C 1/02*** | (2006.01) |
| ***A44C 5/00*** | (2006.01) |
| ***A44C 5/18*** | (2006.01) |
| ***A44C 27/00*** | (2006.01) |
| ***G04B 37/22*** | (2006.01) |

(52) U.S. Cl.

CPC ..... *C22C 5/02* (2013.01); *A44C 5/00* (2013.01); *A44C 5/18* (2013.01); *A44C 27/003* (2013.01); *C22C 1/02* (2013.01); *G04B 37/22* (2013.01)

(58) Field of Classification Search

CPC ..... C22C 5/02

See application file for complete search history.

(56) References Cited

U.S. PATENT DOCUMENTS

| | | | | |
|---|---|---|---|---|
| 5,472,333 | A | 12/1995 | Van Der Zel | |
| 2012/0114522 | A1* | 5/2012 | Reigner | C22C 5/02 420/508 |

FOREIGN PATENT DOCUMENTS

| | | |
|---|---|---|
| DE | 10 2009 053 567 A1 | 5/2011 |
| EP | 0 346 595 A2 | 12/1989 |
| EP | 0 598 431 A1 | 5/1994 |
| JP | 2008-21 4718 | 9/2008 |

OTHER PUBLICATIONS

Machine translation of JP2008-214718 (Japanese document published Sep. 18, 2008).*

Machine translation of JP2008214718 Year 2008.*

European Search report dated Sep. 17, 2015 in European Application No. 15159421, filed on Mar. 17, 2015 ( with English Translation).

* cited by examiner

*Primary Examiner* — Christopher S Kessler

(74) *Attorney, Agent, or Firm* — Oblon, McClelland, Maier & Neustadt, L.L.P.

(57) ABSTRACT

A grey gold alloy which is nickel-free, cobalt-free, iron-free, silver-free, copper-free, zirconium-free, niobium-free, chromium-free and manganese-free, including, expressed in weight percent, from 75.0 to 76.5% of Au, from 15 to 23% of Pd, from 0.5 to 5% of Rh, from 0 to 7% of Pt, and from 0 to 5% of at least one of the alloying elements Ir, Ru, Ti, In, Ga, B and Re, the respective percentages of all the alloying elements adding up to 100%.

20 Claims, No Drawings

GREY GOLD ALLOY

This application claims priority from European Patent Application No. 15159421.5 filed on Mar. 17, 2015, the entire disclosure of which is hereby incorporated herein by reference.

FIELD OF THE INVENTION

The present invention relates to a grey gold alloy which is nickel-free, cobalt-free, iron-free, silver-free, copper-free, zirconium-free, niobium-free, chromium-free and manganese-free. The invention also relates to a timepiece or piece of jewelry comprising at least one component made of such an alloy.

BACKGROUND OF THE INVENTION

There are two main sorts of grey gold alloys on the market: alloys in which the whitening metal for the gold is nickel, and those where this metal is palladium. However, alloys containing nickel are used less and less due to their allergenic properties on contact with the skin, which precludes their use in external timepiece components. Consequently, palladium alloys are used for this function.

Grey gold alloys intended to be used in the fields of watchmaking and jewelry must satisfy two constraints relating first to their brightness/whiteness and secondly to their capacity for deformation. They must therefore have a pure white colour and brightness and excellent ductility and resistance to corrosion. More specifically, the desired grey gold alloys must have values in the L*a*b colour space (CIE 1976) such that L 80, a*<1.5 and b*<7, preferably b*<6, and more preferably b*<5, and a Vickers hardness comprised between 140 HV and 225 HV, the lowest values being the most favourable for deformation.

As the whitening effect of palladium is less than that of nickel, these alloys necessarily have a high palladium content, which reduces their mechanical properties. Further, rhodium plating is often used to improve the colour and reflectivity of the alloys, in order to enhance the brightness of the jewels when the alloys are used for settings.

This rhodium plating is a major long-term drawback because the rhodium plating layer, on the order of 1 to 5 microns, always eventually wears away. Consequently, the after-sales service is faced with an expensive re-plating operation, due to the need to conceal the difference in colour between the alloy and the rhodium improvement layer.

These colours can be compared through several references mentioned above.

EP Patent 1010768 relates to 18 carat grey gold alloys having a palladium content comprised between 12 and 14%, and also comprising cooper, which gives values in the L*a*b colour space such that 1.8<a*<2.3 and 7<b*<10.

EP Patent 1227166 relates to 18 carat, palladium-free, grey gold alloys comprising copper and manganese, which gives values in the L*a*b colour space such that 2.6<a*<6 and 10<b*<13.

EP Patent 1245688 relates to 18 carat grey gold alloys having a palladium content comprised between 5 and 7%, also comprising copper and silver, which gives colour values in the L*a*b system such that 1.5<a*<4.5 and 10.5<b*<15.2.

The a* and b* colour values of the alloys described in these three patents are too high to claim that it is unnecessary to improve the surface by rhodium-plating.

EP Patent Application 2546371 relates to 18 carat grey gold alloys having a palladium content comprised between 2 and 12% and a chromium content comprised between 13 and 23%, which gives values in the L*a*b colour space such that 0.25<a*<0.7 and 3<b*<4.2.

WO Patent Application 2010/127458 relates to 18 carat grey gold alloys having a palladium content comprised between 18 and 24% and a content of various elements comprising Zr, Nb or Mn comprised between 1 and 6%, which gives values in the L*a*b colour space such that 1.1<a*<1.5 and 4.5<b*<5.7.

The alloys described in the latter two patent applications have sufficient a* and b* colour values to claim that it is unnecessary to improve the surface by rhodium-plating. However, the hardness of these alloys is too high (cf. alloys No. 2 (370 HV) and 3 (276 HV) in Tables 1 and 2 below) to ensure ease of use during deformations in the manufacturing process.

SUMMARY OF THE INVENTION

It is therefore an object of the present invention to substantially improve grey gold alloys by providing a grey gold alloy which is nickel-free, cobalt-free, iron-free, silver-free, copper-free, zirconium-free, niobium-free, chromium-free and manganese-free, making it possible to eliminate rhodium plating without reducing the properties of deformability of the alloy.

It is thus an object of the present invention to substantially improve grey gold alloys by providing a grey gold alloy which is nickel-free, cobalt-free, iron-free, silver-free, copper-free, zirconium-free, niobium-free, chromium-free and manganese-free, whose deformability allows for transformation through cold rolling and drawing techniques with no risk of cracking and which is economical to produce.

It is another object of the present invention to provide a grey gold alloy which is nickel-free, cobalt-free, iron-free, silver-free, copper-free, zirconium-free, niobium-free, chromium-free and manganese-free, offering an advantageous compromise between colour and brightness of sufficient whiteness to meet the aesthetic requirements of the field of external watch parts, thereby avoiding a rhodium plating operation, and resistance to oxidation during heat treatments, soldering, welding, melting and laser etching.

It is another object of the present invention to provide a grey gold alloy which is nickel-free, cobalt-free, iron-free, silver-free, copper-free, zirconium-free, niobium-free, chromium-free and manganese-free that is easy to polish and has a high whiteness level after polishing.

To this end, the present invention relates to a grey gold alloy which is nickel-free, cobalt-free, iron-free, silver-free, copper-free, zirconium-free, niobium-free, chromium-free and manganese-free, comprising, expressed in weight percent, from 75.0 to 76.5% of Au, from 15 to 23% of Pd, from 0.5 to 5% of Rh, from 0 to 7% of Pt, and from 0 to 5% of at least one of the alloying elements Ir, Ru, Ti, In, Ga, B and Re, the respective percentages of all the alloying elements adding up to 100%.

With an alloy conforming to the aforementioned definition, there is obtained a grey gold alloy meeting all the criteria required for alloys intended to be used in the fields of watchmaking and jewelry, particularly as regards colour and brightness and capacity for cold deformation with no risk of cracking. This is coupled with excellent corrosion resistance.

The present invention also concerns a timepiece or a piece of jewelry comprising at least one component made of an alloy as defined above. This component is, for example a watch case, a dial, a bracelet or wristband, a bracelet clasp, a jewel or an accessory.

The present invention also concerns the use of an alloy as defined above in a timepiece or piece of jewelry.

DETAILED DESCRIPTION OF PREFERRED EMBODIMENTS

The alloy of the present invention is a grey gold alloy which is nickel-free, cobalt-free, iron-free, silver-free, copper-free, manganese-free, zirconium-free, chromium-free and niobium-free.

According to a first embodiment, the gold alloy is an 18 carat alloy and comprises, expressed in weight percent, from 75.0 to 76.5% of Au, from 15 to 23% of Pd, from 0.5 to 5% of Rh, from 0 to 7% of Pt, and from 0 to 5% of at least one of the alloying elements Ir, Ru, Ti, In, Ga, B and Re, the respective percentages of all the alloying elements adding up to 100%. If present, the percentage of platinum is comprised between 0.5 and 7%.

According to a second embodiment, the gold alloy is an 18 carat alloy and comprises, expressed in weight percent, from 75.0 to 76.5% of Au, from 17 to 22.5% of Pd, from 0.5 to 4% of Rh, from 0 to 6% of Pt, and from 0 to 5% of at least one of the alloying elements Ir, Ru, Ti, In, Ga, B and Re, the respective percentages of all the alloying elements adding up to 100%. If present, the percentage of platinum is comprised between 0.5 and 6%.

According to a third embodiment, the gold alloy is an 18 carat alloy and comprises, expressed in weight percent, from 75.0 to 76.5% of Au, from 18 to 22.5% of Pd, from 1.5 to 3% of Rh, from 0 to 4% of Pt, and from 0 to 4% of at least one of the alloying elements Ir, Ru, Ti, In, Ga, B and Re, the respective percentages of all the alloying elements adding up to 100%. If present, the percentage of platinum is comprised between 1 and 4%.

According to a fourth embodiment, the gold alloy is an 18 carat alloy and comprises, expressed in weight percent, from 75.0 to 76.5% of Au, from 19 to 22% of Pd, from 1.5 to 3% of Rh, from 0 to 4.5% of Pt, and from 0 to 4.5% of at least one of the alloying elements Ir, Ru, Ti, In, Ga, B and Re, the respective percentages of all the alloying elements adding up to 100%. If present, the percentage of platinum is comprised between 1 and 4.5%.

According to a fifth embodiment, the gold alloy is an 18 carat alloy and comprises, expressed in weight percent, from 75.0 to 76.5% of Au, from 19 to 21.5% of Pd, from 1.5 to 3% of Rh, from 0 to 4% of Pt, and from 0 to 4% of at least one of the alloying elements Ir, Ru, Ti, In, Ga, B and Re, the respective percentages of all the alloying elements adding up to 100%. If present, the percentage of platinum is comprised between 1 and 4%.

According to a variant of the above embodiments, the gold alloy comprises at least one of the elements Ir, Ti, in a proportion of each element comprised between 0.002 and 1% by weight.

In a variant where the alloy comprises Ir, the proportion of Ir is preferably comprised between 0.01 and 1% by weight.

In a variant where the alloy comprises Ti, the proportion of Ti is preferably comprised between 20 and 500 ppm.

In a variant wherein the alloy comprises Re, the proportion of Re is preferably comprised between 0.002 and 1% by weight, and preferably close to 0.002% by weight.

In a variant where the alloy comprises In, the proportion of indium is preferably comprised between 1 and 4% by weight.

In a variant where the alloy comprises Ga, the proportion of Ga is preferably comprised between 0.2 and 2% by weight.

In a variant where the alloy comprises B, the proportion of B is preferably comprised between 0.002 and 1% by weight, and more preferably comprised between 0.005 and 0.03% by weight.

In a variant where the alloy comprises Ru, the proportion of Ru is preferably comprised between 0.002 and 1% by weight, and more preferably comprised between 0.008 and 0.015% by weight.

The gold alloys of the invention find particular application in the production of timepieces or pieces of jewelry. In this application, the alloy avoids the need for rhodium plating which is commonly used in the fields of watchmaking and jewelry to give sufficiently white colour and brightness to the parts treated.

To prepare the grey gold alloy according to the invention, the procedure is as follows:

The main elements involved in the composition of the alloy have a purity of between 999 and 999.9 per thousand and are deoxidised.

The elements of the alloy composition are placed in a crucible and heated until the elements melt.

The heating is performed in a sealed induction furnace under a nitrogen partial pressure.

The melted alloy is then poured into an ingot mould.

After solidifying, the ingot is water hardened.

The hardened ingot is then cold rolled and then annealed. The rate of strain hardening between each annealing is from 66 to 80%.

Each annealing operation lasts between 20 to 30 minutes and occurs at 900° C. in a reducing atmosphere comprising $N_2$ and $H_2$.

Cooling between each annealing is accomplished by water quenching.

The following examples have been produced in accordance with the conditions set out in Table 1 above and all relate to 18 carat grey gold alloys or to colour references of alloys available on the market. The proportions indicated are expressed in percentage by weight.

TABLE 1

| N° | Au. | Pd. | Pt. | Rh. | Ag. | Ga. | Fe. | B. | Cu. | Ru. | Ir. | Cr. | Mn. | Zr. | Nb. | In. | Ti. |
|---|---|---|---|---|---|---|---|---|---|---|---|---|---|---|---|---|---|
| 1 (comp.) | 75.1 | 24.9 | | | | | | | | | | | | | | | |
| 2 (comp.) | 75.1 | 7 | | | | | 3 | | | | | 14.9 | | | | | |
| 3 (comp.) | 75.1 | 19 | | | | | | | | | | | 1.9 | 2 | 2 | | |
| 4 (comp.) | 75.1 | 15 | | | | | 6 | | 3.9 | | | | | | | | |
| 5 (comp.) | 75.1 | 21 | | | | 0.5 | | | | | | | | | | 3.4 | |
| 6 (comp.) | 75.5 | 15 | 9 | 0.5 | | | | | | | | | | | | | |

TABLE 1-continued

| N° | Au. | Pd. | Pt. | Rh. | Ag. | Ga. | Fe. | B. | Cu. | Ru. | Ir. | Cr. | Mn. | Zr. | Nb. | In. | Ti. |
|---|---|---|---|---|---|---|---|---|---|---|---|---|---|---|---|---|---|
| 7 (comp.) | 75.5 | 14 | 5 | 0.5 | 5 | | | | | | | | | | | | |
| 8 (inv.) | 76 | 16 | 7 | 1 | | | | | | | | | | | | | |
| 9 (comp.) | 75 | 24 | | 1 | | | | 0.01 | | | | | | | | | |
| 10 (inv.) | 75 | 23 | | 2 | | | | 0.01 | | | | | | | | | |
| 11 (comp.) | 75 | 23 | 2 | | | | | 0.01 | | | | | | | | | |
| 12 (comp.) | 76.5 | 7.5 | 15 | 1 | | | | 0.01 | | | | | | | | | |
| 13 (inv.) | 75.1 | 20.9 | 2 | 2 | | | | | | | | | | | | | 0.01 |
| 14 (inv.) | 75.1 | 22.9 | | 2 | | | | | | | | | | | | | 0.01 |
| 15 (comp.) | 75.1 | 20.9 | | | | | | | | | | | 4 | | | | |
| 16 (inv.) | 75.1 | 17.9 | 5 | 2 | | | | | | | | | | | | | 0.01 |
| 17 (inv.) | 75.1 | 21.9 | | 3 | | | | | | | | | | | | | 0.01 |
| 18 (inv.) | 75.1 | 18.9 | 3 | 3 | | | | | | | | | | | | | 0.01 |
| 19 (inv.) | 75.1 | 18.3 | 5 | 1.6 | | | | | | | | | | | | | 0.01 |
| 20 (inv.) | 75.1 | 21.3 | 2 | 1.6 | | | | | | | | | | | | | 0.01 |
| 21 (inv.) | 75.5 | 20.5 | 1.99 | 2 | | | | | | | 0.01 | | | | | | 0.01 |
| 22 (comp.) | | | | 100 | | | | | | | | | | | | | |

Table 2 below sets out various properties of alloys obtained in examples No 1 to No 22 of Table 1.

Table 2 provides, in particular, indications relating to the Vickers hardness of the alloy in the annealed state, and to the colour measured in a three-axis coordinate system.

This three-dimensional measuring system known as CIELab, CIE being the acronym for the International Commission on Illumination and Lab the axes of the three coordinates; the L axis measures the white-black component (black=0; white=100), the a axis measures the red-green component (red=positive values+a; green=negative values −a), and the b axis measures the yellow-blue component (yellow=positive values+b; blue=negative values −b). (cf. ISO 7724 standard established by the International Commission on Illumination).

The colorimetric values are measured with a MINOLTA CM 3610 d apparatus in the following conditions:

Illuminant: D65

Tilt: 10°

Measurement: SCI+SCE (specular component included+excluded)

UV: 100%

Focal length: 4 mm

Calibration: black body and white body

TABLE 2

| No | L | a* | b* | HV |
|---|---|---|---|---|
| 1 (comp.) | 80.4 | 1.2 | 4.4 | 117 |
| 2 (comp.) | 80.9 | 0.3 | 2.6 | 370 |
| 3 (comp.) | 81.2 | 1.0 | 3.9 | 276 |
| 4 (comp.) | 82.6 | 1.5 | 6.6 | 122 |
| 5 (comp.) | 80.3 | 1.4 | 5.3 | 114 |
| 6 (comp.) | 80.6 | 1.2 | 5.0 | 122 |
| 7 (comp.) | 80.7 | 1.4 | 5.7 | 128 |
| 8 (inv.) | 80.7 | 1.2 | 5.0 | 169 |
| 9 (comp.) | 80.0 | 1.3 | 5.1 | 129 |
| 10 (inv.) | 80.6 | 1.2 | 4.8 | 147 |
| 11 (comp.) | 79.9 | 1.2 | 5.1 | 75 |
| 12 (comp.) | 80.6 | 1.4 | 6.2 | 130 |
| 13 (inv.) | 80.6 | 1.2 | 4.6 | 149 |
| 14 (inv.) | 80.3 | 1.2 | 4.7 | 174 |
| 15 (comp.) | 79.8 | 1.2 | 4.6 | 103 |
| 16 (inv.) | 81.0 | 1.1 | 4.6 | 175 |
| 17 (inv.) | 80.8 | 1.2 | 4.6 | 211 |
| 18 (inv.) | 80.9 | 1.2 | 4.6 | 202 |
| 19 (inv.) | 81.1 | 1.2 | 4.6 | 147 |
| 20 (inv.) | 80.7 | 1.2 | 4.7 | 162 |

TABLE 2-continued

| No | L | a* | b* | HV |
|---|---|---|---|---|
| 21 (inv.) | 80.5 | 1.2 | 4.6 | 147 |
| 22 (comp.) | 90.2 | 1.0 | 2.1 | — |

Alloy No 1 is the binary 18 carat Au—Pd alloy.

Alloys No 2 and No 3 are prior art alloys and have the drawback of excessive hardness.

Alloy No 4 (18 carat gold with 15% Pd) and No 5 (18 carat gold with 21% Pd) are market benchmarks.

Alloy No 22 is the colorimetric reference of rhodium plating.

The 18 carat grey gold alloys of the invention were developed and tested in deformation to meet the dual constraint of brightness/whiteness and capacity for deformation required for alloys intended to be used in the fields of watchmaking and jewelry, namely to have colour values such that L≥80, a*<1.5 et b*<5, and a Vickers hardness comprised between 140 HV and 225 HV, and preferably comprised between 140 HV and 180 HV.

The alloys of the comparative examples do not meet this dual constraint.

What is claimed is:

1. A grey gold alloy, consisting of, expressed in weight percent:

75.0 to 76.5% of Au;

15 to 23% of Pd:

0.5 to 5% of Rh:

0 to 7% of Pt; and 0 to 5% of Ir, 0 to 5% of Ru, less than 0.05% Ti, less than 4% in, less than 2% Ga, less than 0.03% B, and less than 0.002% Re, the respective percentages of all the elements of the alloy adding up to 100%, wherein the grey gold alloy is cold rolled and then annealed, and wherein the grey gold alloy has a hardness from 140 HV to 225 HV.

2. The alloy of claim 1, wherein the Pt is present in at least 0.5%.

3. The alloy of claim 1, wherein the Pd is in a range of from 17 to 22.5%, wherein the Rh is in a range of from 0.5 to 4%, and wherein the Pt, if present, is no more than 6%.

4. The alloy of claim 3, wherein the Pt is present in at least 0.5%.

5. The alloy of claim 1, wherein the Pd is in a range of from 18 to 22.5%, wherein the Rh is in a range of from 1.5 to 3%, wherein the Pt, if present, is no more than 4%, wherein the Ir, if present, is no more than 4%, and wherein the Ru, if present, is no more than 4%.

6. The alloy of claim 5, wherein the Pt is present in at least 1%.

7. The alloy of claim 1, wherein the Pd is in a range of from 19 to 22%, the Rh is in a range of from 1.5 to 3%, the Pt, if present, is no more than 4.5%, the Ir, if present, is no more than 4.5%, and the Ru, if present, is no more than 4.5%.

8. The alloy of claim 7, wherein the Pt is present in at least 1%.

9. The alloy of claim 1, wherein the Pd is in a range of from 19 to 21.5%, the Rh is in a range of from 1.5 to 3%, the Pt, if present, is no more than 4%, the Ir, if present, is no more than 4%, and the Ru, if present, is no more than 4%.

10. The alloy of claim 1, wherein the Ir is present in a range of from 0.002 to 1%, and/or the Ti is present in a range of from 0.002 to 1%.

11. The alloy of claim 1, wherein the Ti is present in a range of from 20 to 500 ppm.

12. The alloy of claim 1, wherein theft is present in a range of from 0.01 to 1%.

13. The alloy of claim 1, wherein the In is present in a range of from 1 to 4%.

14. A timepiece or piece of jewelry, comprising a component made of the alloy of claim 1.

15. The timepiece or piece of jewelry of claim 14, wherein the component is a watch case, a dial, a wristband, a bracelet, a bracelet clasp, a jewel, or an accessory.

16. The alloy of claim 1, having a hardness from 140 HV to 180 HV, and having color values $L \geq 80$, $a^* < 1.5$, and $b^* < 5$.

17. The alloy of claim 1, having color values $L \geq 0.5$, $a^* < 1.2$, and $b^* < 5$.

18. A grey gold alloy, comprising, expressed in weight percent;

75.0 to 76.5% of Au;

15 to 23% of Pd:

0.5 to 5% of Rh:

0 to 7% of Pt; and no more than 1% of Ir, no more than 1% of Ru, no more than 0.05% of Ti, no more than 4% of In, no more than 2% of Ga, no more than 1% of B, no more than 1% of Re, the respective percentages of all the elements of the alloy adding up to 100%, wherein the alloy has color values $L \geq 80.5$, $a^* < 1.2$, and $b^* < 5$, and wherein the alloy has an annealed Vickers hardness in a range of from 140 to 211.

19. The alloy of claim 18, comprising at least 1.99% of the Pt, wherein the annealed Vickers hardness is no more than 175, and wherein the alloy is free of Ni, Co, Fe, Ag, Cu, Zr, Nb, Cr, and Mn.

20. A grey gold alloy, consisting of, expressed in weight percent:

75.0 to 76.5% of Au;

15 to 23% of Pd;

0.5 to 5% of Rh;

0 to 7% of Pt; and no more than 1% of Ir, no more than 1% of Ru, no more than 0.05% of Ti, no more than 4% of In, no more than 2% of Ga, no more than 1% of B, no more than 1% of Re, the respective percentages of all the elements of the alloy adding up to 100%, wherein the alloy has color values $80.5 \leq L \leq 81.1$, $1.1 \leq a^* \leq 1.2$, and $4.6 \leq b^* \leq 5$.

* * * * *